US010543583B2

(12) United States Patent
Arisawa

(10) Patent No.: US 10,543,583 B2
(45) Date of Patent: Jan. 28, 2020

(54) GRINDING TOOL AND MANUFACTURING METHOD THEREFOR

(71) Applicant: MITSUBISHI HEAVY INDUSTRIES MACHINE TOOL CO., LTD., Ritto-shi, Shiga (JP)

(72) Inventor: Hideaki Arisawa, Tokyo (JP)

(73) Assignee: MITSUBISHI HEAVY INDUSTRIES MACHINE TOOL CO., LTD., Shiga (JP)

( * ) Notice: Subject to any disclaimer, the term of this patent is extended or adjusted under 35 U.S.C. 154(b) by 413 days.

(21) Appl. No.: 15/534,662

(22) PCT Filed: Dec. 7, 2015

(86) PCT No.: PCT/JP2015/084233
§ 371 (c)(1),
(2) Date: Jun. 9, 2017

(87) PCT Pub. No.: WO2016/093186
PCT Pub. Date: Jun. 16, 2016

(65) Prior Publication Data

US 2018/0264629 A1 Sep. 20, 2018

(30) Foreign Application Priority Data

Dec. 12, 2014 (JP) ..... 2014-251631

(51) Int. Cl.
*B24D 5/10* (2006.01)
*B24D 18/00* (2006.01)

(52) U.S. Cl.
CPC ..... *B24D 5/10* (2013.01); *B24D 18/009* (2013.01)

(58) Field of Classification Search
CPC ..... B24D 5/10; B24D 18/00; B24D 18/009
(Continued)

(56) References Cited

U.S. PATENT DOCUMENTS 3,324,607 A * 6/1967 Niemiec ..... B24D 5/06 451/488
4,199,903 A * 4/1980 Fitzpatrick ..... B24B 33/085 451/471
2016/0288294 A1 10/2016 Arisawa

FOREIGN PATENT DOCUMENTS

DE 4128028 A1 2/1993
EP 2891540 A1 7/2015
(Continued)

OTHER PUBLICATIONS

International Preliminary Report on Patentability and Written Opinion of the International Searching Authority (Forms PCT/IB/338, PCT/IB/373 and PCT/ISA/237) issued in International Application No. PCT/JP2015/084233 dated Jun. 22, 2017, together with an English translation.
(Continued)

*Primary Examiner* — Robert A Rose
(74) *Attorney, Agent, or Firm* — Birch, Stewart, Kolasch & Birch, LLP

(57) ABSTRACT

The object of the present invention is to provide a grinding tool capable of continuing machining in a dry state and of being manufactured in a short time and at low cost, and a manufacturing method therefor. For said purpose, a grinding tool (10-1) for grinding a workpiece includes a threaded helical groove (12) formed on an outer circumferential surface of a cylindrical metal head portion (10*b*), ridgetop surfaces that result from the formation of the helical groove (12) and are formed so as to protrude with a trapezoidal cross-sectional shape, and abrasive grain surfaces (18) formed by winding an insulating resin rope in the helical groove (12) to mask the inside of the helical groove (12) and fixing abrasive grains on the ridgetop surfaces. A helix angle of the helical groove (12) with respect to an axial direction
(Continued)

of the grinding tool (10-1) is set to be at least 80° and less than 90°.

6 Claims, 12 Drawing Sheets

(58) Field of Classification Search
USPC ..... 451/547, 541, 450, 508, 53; 51/293
See application file for complete search history.

(56) References Cited

FOREIGN PATENT DOCUMENTS

| | | | |
|---|---|---|---|
| JP | 54-21286 | U | 2/1979 |
| JP | 58-59765 | A | 4/1983 |
| JP | 59-191256 | U | 12/1984 |
| JP | 61-27665 | U | 2/1986 |
| JP | 63-110313 | U | 7/1988 |
| JP | 1-271176 | A | 10/1989 |
| JP | 2-35676 | U | 3/1990 |
| JP | 4-13260 | U | 2/1992 |
| JP | 5-269669 | A | 10/1993 |
| JP | 6-114629 | A | 4/1994 |
| JP | 2009-196018 | A | 9/2009 |
| JP | 2014-46368 | A | 3/2014 |
| JP | 2015-120228 | A | 7/2015 |
| WO | WO 2015/098194 | A1 | 7/2015 |

OTHER PUBLICATIONS

International Search Report and Written Opinion of the International Searching Authority (Forms PCT/ISA210, PCT/ISA/220 and PCT/ISA/237) issued in International Application No. PCT/JP2015/084233 dated Feb. 16, 2016, together with an English translation.

* cited by examiner

GRINDING TOOL AND MANUFACTURING METHOD THEREFOR

TECHNICAL FIELD

The present invention relates to a grinding tool and a method of manufacturing the grinding tool.

BACKGROUND ART

A grinding tool is a tool that includes a multiplicity of abrasive grains electrodeposited on an outer circumferential surface of a base metal having a disc shape, cylindrical shape, or the like. As illustrated in FIG. 3, a workpiece W is ground by rotating such a grinding tool T at high speed in a rotational direction R and, at the same time, moving the grinding tool T relative to the workpiece W in a feeding direction F by certain amounts of depth of cut and feed.

CITATION LIST

Patent Documents

Patent Document 1: Japanese Unexamined Patent Application Publication No. 2014-046368A Patent Document 2: Japanese Utility Model Application Publication No. S63-110313

SUMMARY OF INVENTION

Technical Problem

Examples of a grinding tool provided with electrodeposited abrasive grains include those provided with a chip pocket such as a dimple or a through-hole. For example, as illustrated in FIGS. 4A and 4B, a dimple-type grinding tool 30 is provided with a multiplicity of dimples 32 as well as a multiplicity of electrodeposited abrasive grains 33 on an outer circumferential surface of a base metal 31 having a cylindrical shape. In this case, while each of the dimples 32 serves as an escape (chip pocket) for chips C during grinding, removal of the chips C requires a supply of grinding oil as well as an air blow B from outside the grinding tool 30 to the dimples 32.

Further, as illustrated in FIGS. 5A and 5B, a through-hole type grinding tool 40 is provided with a multiplicity of through-holes 43 that extend in a radial direction through a base metal 41 having a cylindrical shape, and a multiplicity of abrasive grains 44 electrodeposited on an outer circumferential surface of the grinding tool 40. In this grinding tool 40, an interior of the base metal 41 serves as a flow channel 42. In this case, while each of the through-holes 43 serves as an escape (chip pocket) for the chips C during grinding, removal of the chips C requires a supply of grinding oil as well as the air blow B from inside the grinding tool 40 to the through-holes 43 via the flow channel 42.

Thus, when the above-described types of tools are used to perform a full dry cut without an external supply of an air blow or the like, chip removal from the chip pockets may not be possible. This results in the occurrence of chip clogging and the inability to continue grinding. Further, the manufacture of the above-described types of tools requires the machining of a multiplicity of dimples and a multiplicity of through-holes, which takes significant time and money.

In light of the foregoing, the object of the present invention is to provide a grinding tool capable of continuing machining in a dry state and of being manufactured in a short time and at low cost, and a manufacturing method therefor.

Solution to Problem

The grinding tool according to a first aspect of the present invention for solving the above-described problems includes a threaded helical groove formed on an outer circumferential surface of a metal cylinder, ridgetop surfaces that result from the formation of the helical groove and are formed so as to protrude with a trapezoidal cross-sectional shape, and abrasive grain surfaces formed by fixing abrasive grains on the ridgetop surfaces.

A grinding tool according to a second aspect of the present invention for solving the above-described problems is the grinding tool according to the first aspect, wherein a helix angle of the helical groove with respect to an axial direction of the grinding tool is set to be at least 80° and less than 90°.

A method of manufacturing a grinding tool according to a third aspect of the present invention for solving the above-described problems includes the steps of forming a threaded helical groove on an outer circumferential surface of a metal cylinder, forming ridgetop surfaces that result from the formation of the helical groove and protrude with a trapezoidal cross-sectional shape, and forming abrasive grain surfaces by masking an inside of the helical groove and fixing abrasive grains on the ridgetop surfaces.

A method of manufacturing a grinding tool according to a fourth aspect of the present invention for solving the above-described problems is the method of manufacturing a grinding tool according to the third aspect, wherein the helical groove is formed so that a helix angle of the helical groove with respect to an axial direction of the grinding tool is set to be at least 80° and less than 90°.

A method of manufacturing a grinding tool according to a fifth aspect of the present invention for solving the above-described problems is the method of manufacturing a grinding tool according to the third or fourth aspect, wherein the inside of the helical groove is masked by winding an insulating resin rope in the helical groove.

A grinding tool according to a sixth aspect of the present invention for solving the above-described problems is the grinding tool according to the first or second aspect, further including an axial center hole that extends in an axial direction through an axial center portion of the cylinder, and a communicating hole that communicates a bottom surface of the helical groove and the axial center hole.

A grinding tool according to a seventh aspect of the present invention for solving the above-described problems is the grinding tool according to the sixth aspect, further including a linear groove on an inner peripheral surface of the axial center hole. The linear groove has a depth that reaches the bottom surface of the helical groove, and extends along an axial direction. Further, the linear groove and the bottom surface of the helical groove overlap at the communicating hole.

A grinding tool according to an eighth aspect of the present invention for solving the above-described problems is the grinding tool according to the sixth aspect, wherein a center line of the communicating hole is orthogonal to an axial center of the cylinder.

A grinding tool according to a ninth aspect of the present invention for solving the above-described problems is the grinding tool according to the sixth aspect, wherein a center line of the communicating hole is inclined relative to an axial center of the cylinder so that an opening on the axial center hole side is positioned on a leading end side of an opening on the bottom surface side of the helical groove.

A grinding tool according to a tenth aspect of the present invention for solving the above-described problems is the grinding tool according to the ninth aspect, wherein the communicating hole is curved so that an inclination of the center line decreases with respect to the axial center of the cylinder, from the bottom surface of the helical groove toward the inner peripheral surface of the axial center hole.

A grinding tool according to an eleventh aspect of the present invention for solving the above-described problems is the grinding tool according to the ninth or tenth aspect, wherein the leading end side of the axial center hole increases in size toward a leading end of the cylinder.

A grinding tool according to a twelfth aspect of the present invention for solving the above-described problems is the grinding tool according to any one of the ninth to eleventh aspects, wherein the communicating hole has an inclination angle toward a front side of the cylinder in a rotational direction, relative to a radial direction of the cylinder.

A grinding tool according to a thirteenth aspect of the present invention for solving the above-described problems is the grinding tool according to the twelfth aspect, wherein the communicating hole is curved so that the inclination angle increases from the inner peripheral surface of the axial center hole toward the bottom surface of the helical groove.

A grinding tool according to a fourteenth aspect of the present invention for solving the above-described problems is the grinding tool according to any one of the sixth to thirteenth aspects, wherein the communicating hole increases in size from the bottom surface of the helical groove toward the inner peripheral surface of the axial center hole.

A method of manufacturing a grinding tool according to a fifteenth aspect of the present invention for solving the above-described problems is the method of manufacturing a grinding tool according to any one of the third to fifth aspects, the method further including, before the step of forming the abrasive grain surfaces, the steps of forming an axial center hole that extends in an axial direction through an axial center portion of the cylinder, forming, on an inner peripheral surface of the axial center hole, a linear groove having a depth that reaches a bottom surface of the helical groove and extending in the axial direction, and forming a communicating hole that communicates the bottom surface of the helical groove and the axial center hole at a position where the linear groove and the bottom surface of the helical groove overlap.

Advantageous Effects of Invention

According to the first and second aspects, chips are forcibly removed along the helical groove, which is free of abrasive grains, when the grinding tool is rotated, making it possible to continue machining in a dry state.

According to the third to fifth aspects, the helical groove can be manufactured easily and in a short time by lathe turning, and the abrasive grains can be fixed on the ridgetop surfaces easily and in a short time by masking the inside of the helical groove. This makes it possible to manufacture the grinding tool in a short time and at low cost.

According to the sixth to fourteenth aspects, both the axial center hole that extends in the axial direction through the axial center portion of the cylinder and the communicating hole that communicates the bottom surface of the helical groove and the axial center hole are provided, thereby making it possible to discharge the chips through the communicating hole and improve chip dischargeability.

According to the fifteenth aspect, the linear groove having a depth that reaches the bottom surface of the helical groove is formed on the inner peripheral surface of the axial center hole in the axial direction, thereby making it possible to manufacture the communicating hole that communicates the bottom surface of the helical groove and the axial center hole relatively easily.

BRIEF DESCRIPTION OF DRAWINGS

FIG. 1A is a perspective view of the grinding tool, and FIG. 1B is a broken enlarged view of section A1 of FIG. 1A.

FIG. 4A is an overall diagram of a right half in a cross-sectional view, and FIG. 4B is an enlarged view of section A2 in FIG. 4A.

FIG. 5A is an overall diagram of a right half in a cross-sectional view, and FIG. 5B is an enlarged view of section A3 in FIG. 5A.

FIG. 7A is a cross-sectional view in an axial direction thereof, and FIG. 7B is a cross-sectional view in a radial direction thereof.

FIG. 9A is a cross-sectional view in an axial direction thereof, and FIG. 9B is a cross-sectional view in a radial direction thereof.

FIG. 10A is a cross-sectional view in an axial direction thereof, and FIG. 10B is a cross-sectional view in a radial direction thereof.

FIG. 11A is a cross-sectional view in an axial direction thereof, and FIG. 11B is a cross-sectional view in a radial direction thereof.

FIG. 12A is a cross-sectional view in an axial direction thereof, and FIG. 12B is a cross-sectional view in a radial direction thereof.

DESCRIPTION OF EMBODIMENTS

The following describes embodiments of a grinding tool and a method of manufacturing the grinding tool according to the present invention, with reference to FIGS. 1A to 2H.

Embodiment 1

Figure 1A:
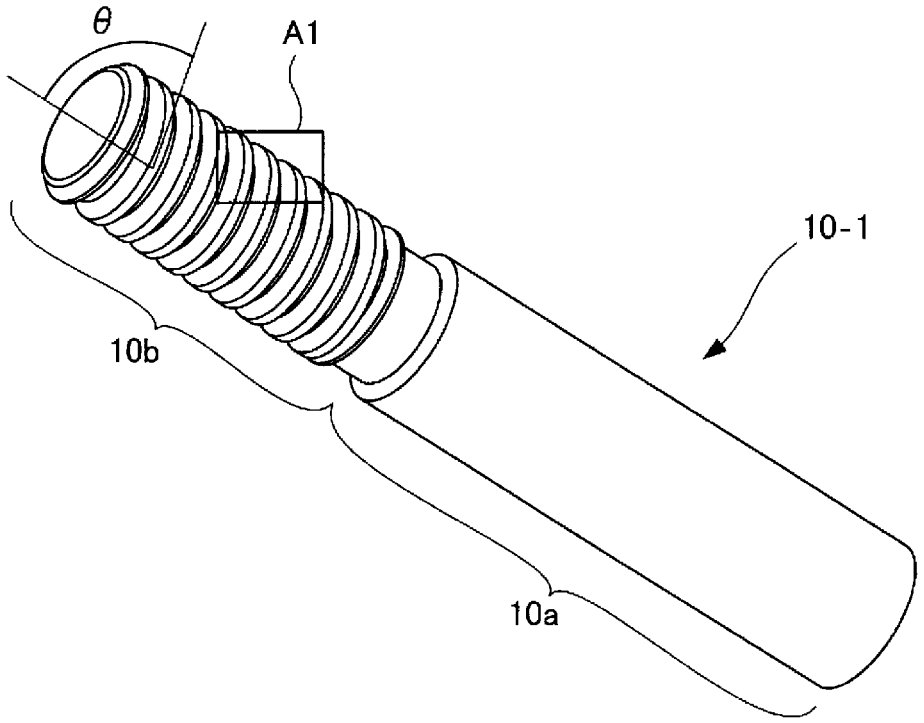
FIGS. 1A and 1B illustrate an example (Embodiment 1) of an embodiment of a grinding tool according to the present invention.
Figure 1B:
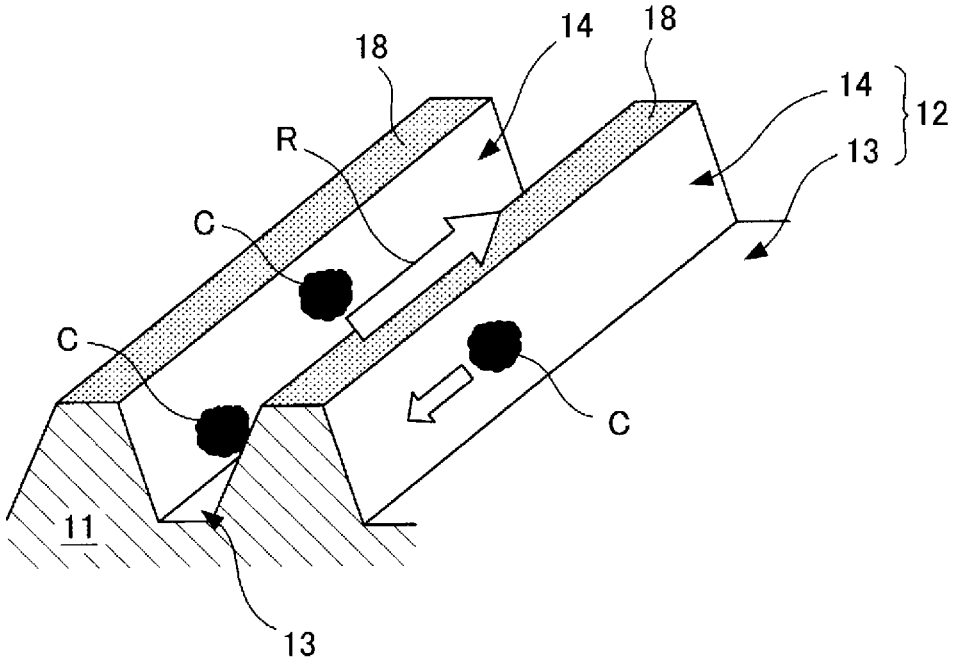

FIG. 1A is a perspective view illustrating a grinding tool of the present embodiment, and FIG. 1B is a broken, enlarged view of section A1 of FIG. 1A.

A grinding tool 10-1 of the present embodiment includes a shaft portion 10*a* retained on a main shaft of a machine tool or the like and rotated at high speed, and a head portion 10*b* that grinds a workpiece.

The shaft portion 10*a* is made of a metal such as carbon steel, and a surface thereof is free of electrodeposited Ni and abrasive grains described later.

Further, the head portion 10*b* includes a base metal 11 made of a metal such as carbon steel, similar to the shaft portion 10*a*, a helical groove 12 formed in a threaded manner on a surface of the base metal 11, and abrasive grain surfaces 18 formed by fixing a multiplicity of abrasive grains 18*a* (refer to FIGS. 2A to 2H described later) on ridgetop surfaces 15 that result from the formation of the helical groove 12 and are formed so as to protrude with a trapezoidal cross-sectional shape.

A helix angle θ of the helical groove 12 is formed so as to be at least 80° and less than 90° with respect to an axial direction of the grinding tool 10-1. That is, the helix angle θ of the helical groove 12 is substantially orthogonal to the axial direction of the grinding tool 10-1, and substantially parallel with a rotational direction R of the grinding tool 10-1.

Further, the helical groove 12 includes a bottom surface 13 and side surfaces 14, and a groove cross section formed by these is formed in an inverted trapezoidal shape, extending toward an outer peripheral side. Then, the multiplicity of abrasive grains 18*a* are electrodeposited on the ridgetop surfaces 15 and not electrodeposited on the bottom surface 13 or the side surfaces 14, that is, inside the helical groove 12.

When the grinding tool 10-1 of the configuration described above is used to grind a workpiece while rotated at high speed in the rotational direction R, chips C produced by the grinding by the abrasive grain surfaces 18 enter the helical groove 12 serving as a chip pocket, and are discharged along this helical groove 12.

At this time, the helix angle θ of the helical groove 12 is substantially orthogonal to the axial direction of the grinding tool 10-1 and increased in size, thereby causing a reaction force in response to the rotational force of the grinding tool 10-1 to act on the chips C that entered the helical groove 12. As a result, the chips C are forcibly removed in a direction opposite the rotational direction R, along the helical groove 12. Moreover, the abrasive grains 18*a* are not electrodeposited inside the helical groove 12, allowing the chips C that entered the helical groove 12 to be smoothly discharged without hindrance by the abrasive grains 18*a*. Thus, the chips C that entered the helical groove 12 are easily discharged, making it possible to continue machining without the supply of grinding oil or an air blow.

Next, a method of manufacturing the grinding tool 10-1 of the present embodiment will be described with reference to FIGS. 2A to 2H. Here, FIGS. 2A to 2H are cross-sectional views illustrating the steps of the method of manufacturing a grinding tool of the present embodiment.

First, the helical groove 12 having the configuration described above is formed on a cylindrical member made of a metal such as carbon steel, by lathe turning. The section where this helical groove 12 is formed serves as the head portion 10*b* described above, and all other sections serve as the shaft portion 10*a*. With formation of such a helical groove 12, the bottom surface 13 and the side surfaces 14 are formed on the surface of the base metal 11, and the ridgetop surfaces 15 are formed so as to protrude with a trapezoidal cross-sectional shape (refer to FIG. 2A). The ridgetop surfaces 15 are also formed into a helical shape along the helical groove 12. The sections of the ridgetop surfaces 15 do not function as a blade such as an end mill, but rather as a grinding wheel surface for grinding.

Figure 4A:
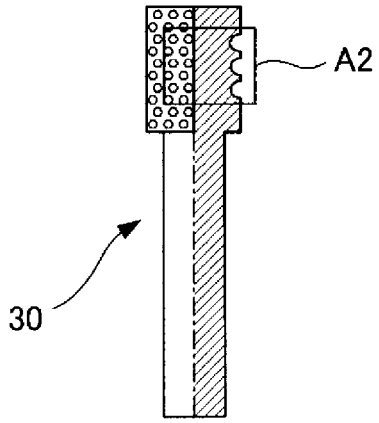
FIGS. 4A and 4B are diagrams for explaining a dimple-type grinding tool.
Figure 4B:
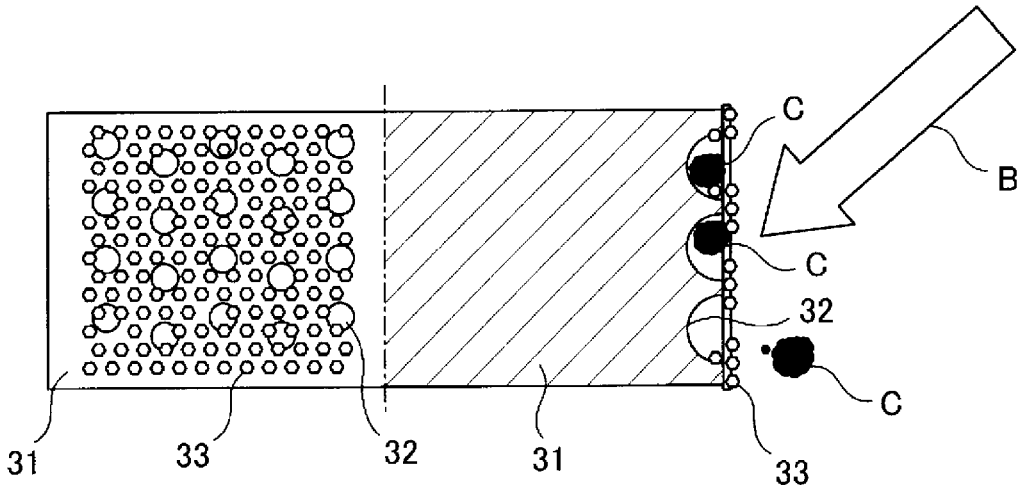
Figure 5A:
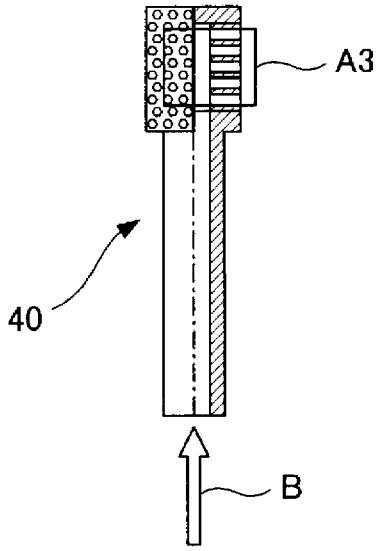
FIGS. 5A and 5B are diagrams for explaining a through-hole type grinding tool.
Figure 5B:
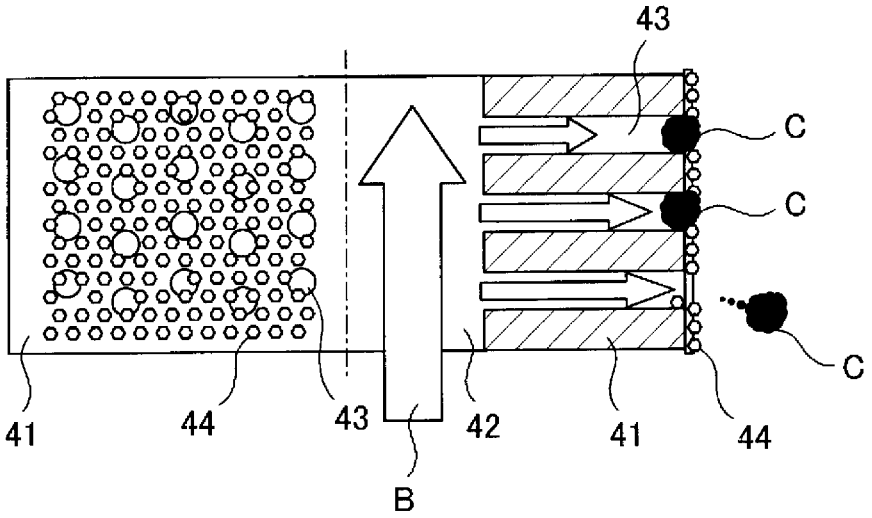

Unlike the chip pockets formed by the dimples 32 of the grinding tool 30 illustrated in FIGS. 4A and 4B and the chip pockets formed by the through-holes 43 of the grinding tool 40 illustrated in FIGS. 5A and 5B, the helical groove 12 serving as a chip pocket in the present embodiment is machined by lathe turning as described above and therefore can be manufactured easily and in a short time, making it possible to decrease the manufacturing time of the grinding tool 10-1 and thus reduce cost.

Figure 2A:
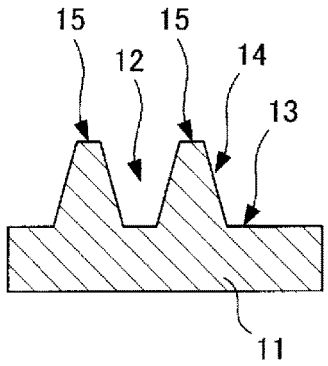
FIGS. 2A to 2H are diagrams for explaining an example (Embodiment 1) of a method of manufacturing a grinding tool according to the present invention, each showing a cross-sectional view of a step.
Figure 2B:
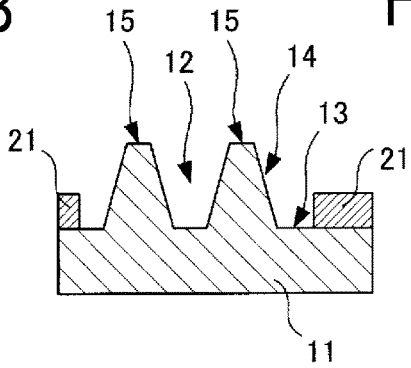
Figure 2C:
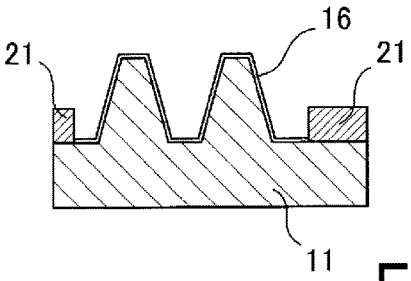
Figure 2D:
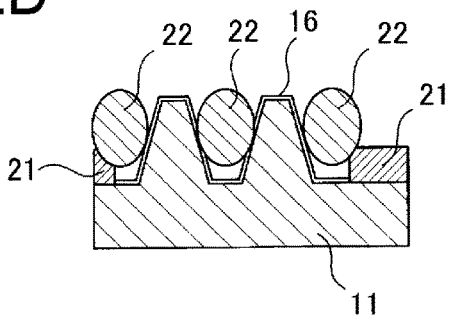
Figure 2E:
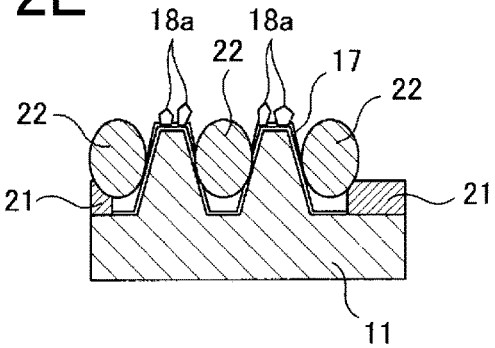

Next, a masking portion 21 is formed in a section that is not Ni plated (refer to FIG. 2B). For example, the masking portion 21 is formed in a section of the shaft portion 10*a* that is not Ni plated. Thus, the masking portion 21 is provided to a section free of electrodeposition and plating, such as a shank portion. Formation of the masking portion 21 makes it possible to prevent abrasive grains and the like described later from being electrodeposited on the entire tool surface, and prevent elimination of a reference surface (precision deterioration) of a tool retaining portion and the like. Examples of this masking portion 21 include an insulating resin solvent that is applied and dried, and an insulating resin seal or resin tape.

Next, pretreatment is performed. Specifically, (1) alkali degreasing, (2) electrolytic degreasing, and (3) acid activity are performed on the head portion 10*b* where the masking portion 21 has not been formed, cleaning the surface to be plated.

Next, a plating layer 16 obtained by a Ni strike plating process is formed as a base plating by electrodeposition on the head portion 10*b* where the masking portion 21 has not been formed. That is, the plating layer 16 is formed on the ridgetop surfaces 15 and the helical groove 12 (the bottom surface 13 and the side surfaces 14) where the masking portion 21 has not been formed (refer to FIG. 2C). Here, an electrolytic Ni plating is preferred. This plating layer 16 makes it possible to maintain adhesion.

Next, the masking of the inside of the helical groove 12 (the bottom surface 13 and the side surfaces 14) is performed. Specifically, masking is performed by winding a resin rope 22 with insulating properties in the helical groove 12 (refer to FIG. 2D). As a result, electrodeposition of the abrasive grains 18*a* inside (on the bottom surface 13 and the side surfaces 14) the helical groove 12 is avoided. Note that while the resin rope 22 is used here, other materials may be used as long as the material has insulating properties capable of masking the helical groove 12.

Next, to temporarily fix the abrasive grains 18*a* made of diamond or the like by electrodeposition, a plating layer 17 obtained by a support plating process is formed. At this time, the shaft portion 10*a* is masked by the masking portion 21, and the inside (the bottom surface 13 and the side surfaces 14) of the helical groove 12 is masked by the resin rope 22. Thus, electrodeposition of the abrasive grains 18*a* onto the helical groove 12 (the bottom surface 13 and the side surfaces 14) is avoided and the multiplicity of abrasive grains 18*a* are temporarily fixed by the plating layer 17 on the ridgetop surfaces 15 that are not masked (refer to FIG. 2E). Here, as well, electrolytic Ni plating is preferred. Note that the abrasive grains 18*a* may be electrodeposited around the ridgetop surfaces 15, such as on the ridgetop surface 15 side of each of the side surfaces 14, as long as electrodeposition onto a valley floor portion of the helical groove 12 serving as the chip pocket can be avoided.

Thus, the inside of the helical groove 12 is masked by the resin rope 22 and the multiplicity of abrasive grains 18*a* are electrodeposited on the ridgetop surfaces 15, making it possible to decrease the manufacturing time of the grinding tool 10-1 and, in turn, lower cost. Further, according to the grinding tool 10-1 of the present embodiment, when the chips C stocked in the helical groove 12 serving as a chip pocket need to be removed without the external supply of an air blow or the like, and the abrasive grains 18*a* are electrodeposited inside (on the bottom surface 13 and the side surfaces 14) the helical groove 12, resistance occurs when the chips C are discharged, decreasing dischargeability. However, masking the inside of the helical groove 12 with the resin rope 22 makes it possible to avoid electrodeposition of the abrasive grains 18*a* inside the helical groove 12 and prevent deterioration of dischargeability of the chips C.

Figure 2F:
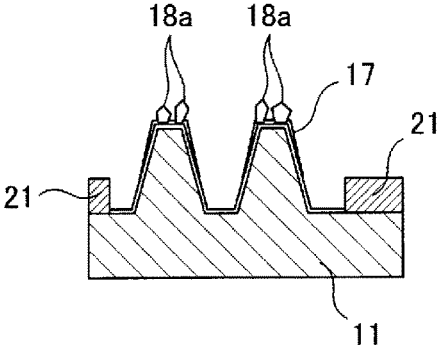

Next, the resin rope 22 is removed from the helical groove 12 (the bottom surface 13 and the side surfaces 14) (refer to FIG. 2F).

Figure 2G:
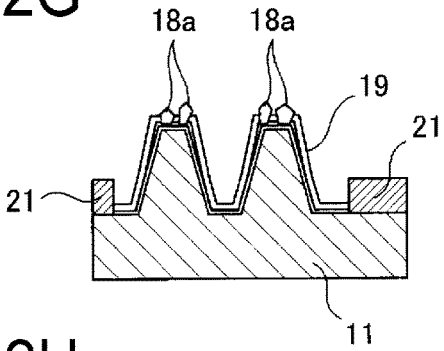

Next, to fix the multiplicity of abrasive grains 18*a*, a plating layer 19 obtained by a fixing plating process is formed (refer to FIG. 2G). This plating layer 19 fixes the multiplicity of abrasive grains 18*a*, forming the abrasive grain surfaces 18. Here, an electroless Ni—P plating is preferred.

Figure 2H:
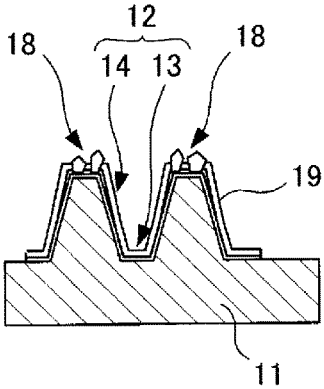
Figure 3:
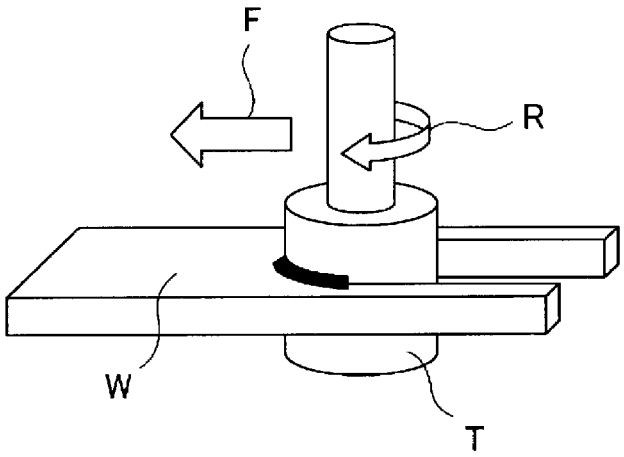
FIG. 3 is a perspective view for explaining grinding by the grinding tool.

Lastly, the masking portion 21 is removed, and drying is subsequently performed, thereby completing the grinding tool 10-1 (refer to FIG. 2H). The masking portion 21, whether obtained by drying a resin solvent or using a resin seal or a resin tape, may be simply removed by peeling.

With the steps described above, it is possible to manufacture the grinding tool 10-1 in a short time and at low cost while avoiding the electrodeposition of the abrasive grains 18*a* inside the helical groove 12.

Embodiment 2

Figure 6:
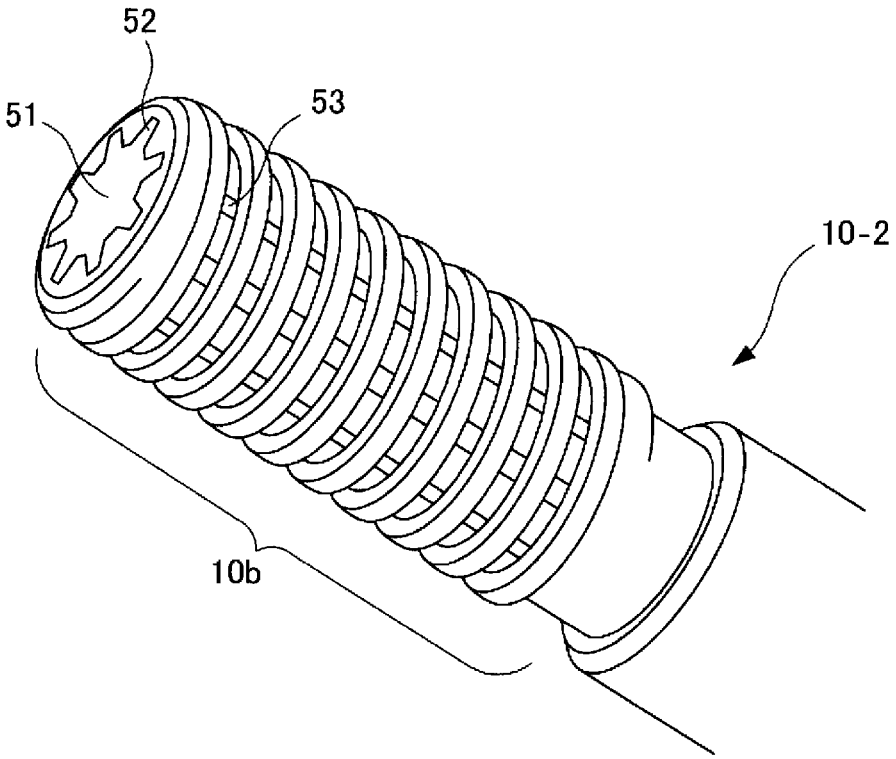
FIG. 6 is a perspective view illustrating another example (Embodiment 2) of an embodiment of the grinding tool according to the present invention.
Figure 7A:
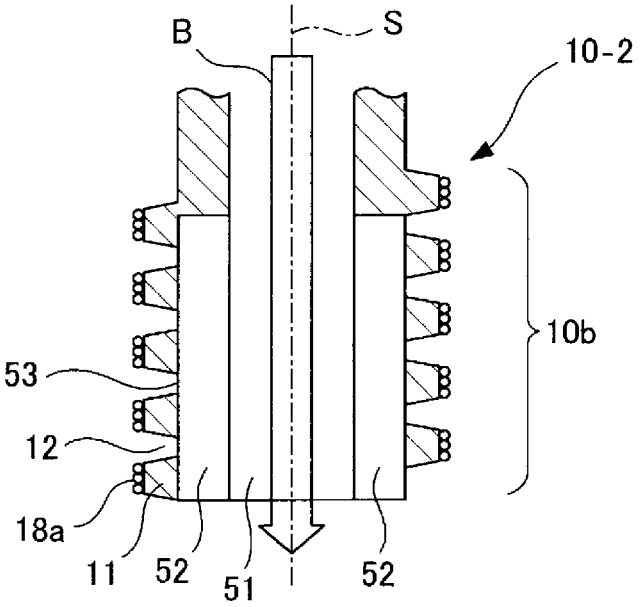
FIGS. 7A and 7B are cross-sectional views illustrating the grinding tool illustrated in FIG. 6.
Figure 7B:
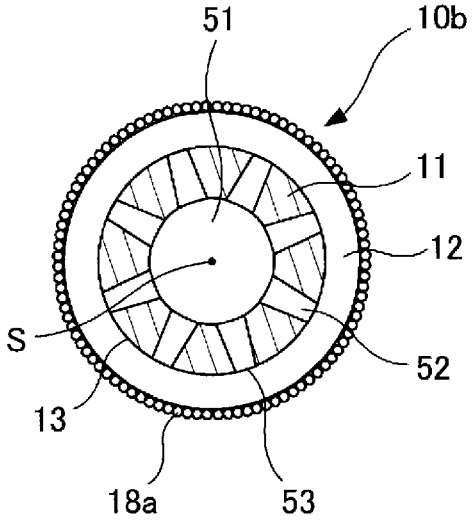

FIG. 6 is a perspective view illustrating the grinding tool of the present embodiment. Further, FIGS. 7A and 7B are cross-sectional views illustrating the grinding tool illustrated in FIG. 6. FIG. 7A is a cross-sectional view in an axial direction thereof, and FIG. 7B is a cross-sectional view in a radial direction thereof.

A grinding tool 10-2 of the present embodiment uses the grinding tool 10-1 described in Embodiment 1 as a basic structure. Thus, in the description of the present embodiment, the same components as those of the grinding tool 10-1 described in Embodiment 1 are denoted using the same symbols.

While the grinding tool 10-1 described in Embodiment 1 can continue machining in a dry state for a long time, the chips C may no longer be removable when machining is continued. Conceivably, grinding oil may be supplied or an air blow may be performed to support the removal of the chips C. However, grinding oil is not used when machining in a dry state. Accordingly, an air blow must be performed to support the removal of the chips C. However, even in this case, the chips C may no longer be removable when machining is continued for a long time. If the chips C are no longer removable, clogging occurs, making continuous machining no longer possible.

Here, while the grinding tool 10-2 of the present embodiment uses the grinding tool 10-1 described in Embodiment 1 as a basic structure, the grinding tool 10-2 is further provided with an axial center hole 51 that extends in the axial direction through an axial center portion thereof. Further, at least one linear groove 52 that has a depth that reaches the bottom surface 13 of the helical groove 12 and extends in the axial direction is formed on an inner peripheral surface of the axial center hole 51 of a section of the head portion 10*b*. As a result, a plurality of communicating holes 53 are formed on the bottom surface 13 of the helical groove 12. That is, the section where the bottom surface 13 of the helical groove 12 and the linear groove 52 overlap serves as the communicating hole 53 that communications with the axial center hole 51 from the bottom surface 13 of the helical groove 12.

In the present embodiment, the linear groove 52, in a cross section in the axial direction, is linearly formed in the axial direction, as illustrated in FIG. 7A. Further, in a cross section in a radial direction, the linear groove 52 is formed into a tapered shape that increases in size from the bottom surface 13 of the helical groove 12 toward the inner peripheral surface of the axial center hole 51, and is formed so that a center line thereof is directed toward an axial center S, as illustrated in FIG. 7B. The axial center hole 51 and the linear grooves 52 are shaped like a so-called internal gear. Note that the linear groove 52 may be formed so that the size is the same from the bottom surface 13 of the helical groove 12 to the inner peripheral surface of the axial center hole 51.

In the grinding tool 10-2 of the present embodiment, when the air blow B is performed in the axial center hole 51, the chips C that were not removed and remain in the helical groove 12 pass through the communicating holes 53, are suctioned into and pass through the axial center hole 51, and are forcibly discharged to the outside. As a result, chip dischargeability is improved.

Note that a lid member (not illustrated) that blocks the axial center hole 51 and the linear grooves 52 may be provided in the leading end portion of the grinding tool 10-2 of the present embodiment. In such a case, when the air blow B is performed in the axial center hole 51, the chips C that were not removed and remain in the helical groove 12 are forcibly discharged to the outside by the air jetted from the communicating holes 53. As a result, chip dischargeability is improved. In this case, each of the linear grooves 52 is formed into a tapered shape that increases in size from the inner peripheral surface of the axial center hole 51 toward the bottom surface 13 of the helical groove 12. With such a shape, entry of the chips C accumulated in the linear grooves 52 into the axial center hole 51 can be suppressed, and the chips C accumulated in the linear grooves 52 can be reliably discharged to the outside without clogging the linear grooves 52.

Next, a method of manufacturing the grinding tool 10-2 of the present embodiment will be described with reference to FIGS. 6 to 7B as well as the aforementioned FIGS. 2A to 2H.

First, the helical groove 12 having the configuration described above is formed on a cylindrical member made of a metal such as carbon steel, by lathe turning. The section where this helical groove 12 is formed serves as the head portion 10*b* described above, and all other sections serve as the shaft portion 10*a*. With formation of such a helical groove 12, the bottom surface 13 and the side surfaces 14 are formed on the surface of the base metal 11, and the ridgetop surfaces 15 are formed so as to protrude with a trapezoidal cross-sectional shape (refer to FIG. 2A). The ridgetop surfaces 15 are also formed into a helical shape along the helical groove 12. The sections of the ridgetop surfaces 15 do not function as a blade such as an end mill, but rather as a grinding wheel surface for grinding.

Next, the axial center hole 51 is formed so as to extend in the axial direction through the axial center portion of the grinding tool 10-2, and subsequently the linear grooves 52 are formed on the inner peripheral surface of the axial center hole 51 of the section of the head portion 10*b*, thereby forming the communicating holes 53. The linear grooves 52 may be machined by lathe turning and, for example, may be formed one by one using a slotter or the like. Or, if machined using multiple blades, a plurality of the linear grooves 52 may be formed all at once using a shaper shaped like a gear blade or the like. That is, before formation of the abrasive grain surfaces 18, the axial center hole 51 and the linear grooves 52 are formed, thereby forming the communicating holes 53.

Subsequently, as described using the aforementioned FIGS. 2B to 2H, the multiplicity of abrasive grains 18*a* are electrodeposited on the ridgetop surfaces 15 while avoiding electrodeposition of the abrasive grains 18*a* inside the helical groove 12, thereby forming the abrasive grain surfaces 18. At this time, naturally, electrodeposition of the abrasive grains 18*a* onto the axial center hole 51, the linear grooves 52, and the communicating holes 53 is also avoided.

While the grinding tool 10-2 of the present embodiment includes the axial center hole 51, the linear grooves 52, and the communicating holes 53 in addition to the grinding tool 10-1 described in Embodiment 1, the linear grooves 52 can be machined by lathe turning as described above, making it possible to manufacture the grinding tool 10-2 at low cost and relatively easily.

Embodiment 3

Figure 8:
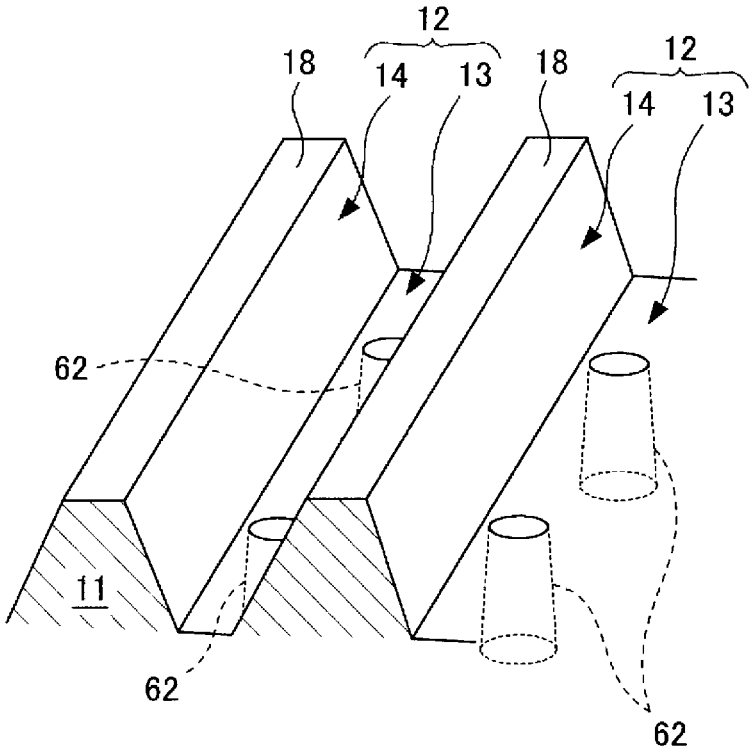
FIG. 8 is a diagram illustrating another example (Embodiment 3) of an embodiment of the grinding tool according to the present invention, and is a partially enlarged view.
Figure 9A:
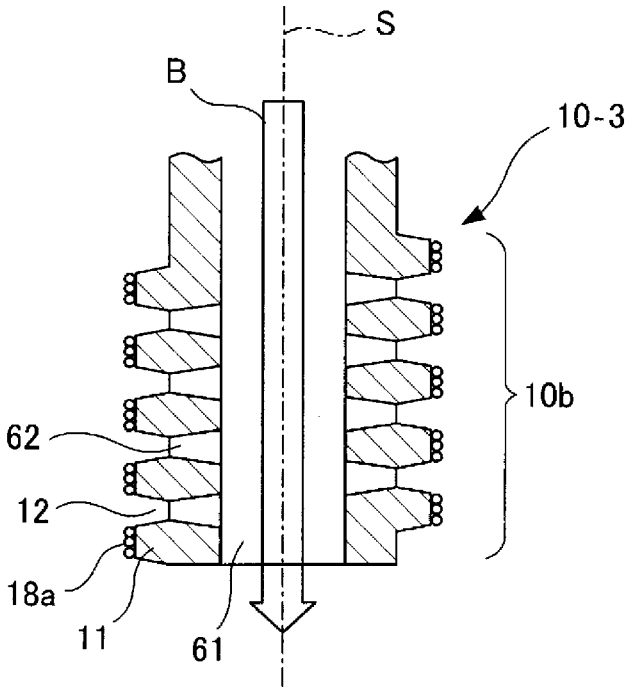
FIGS. 9A and 9B are cross-sectional views illustrating the grinding tool illustrated in FIG. 8.
Figure 9B:
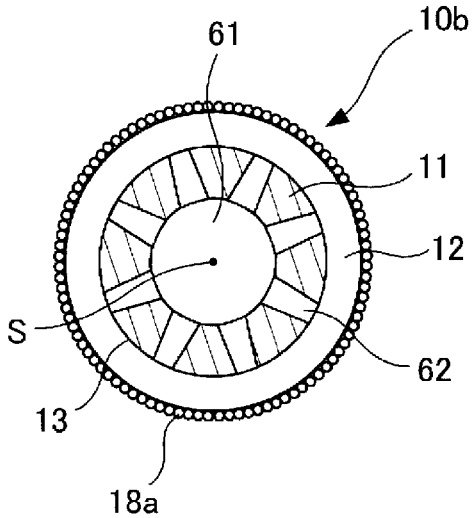

FIG. 8 is an enlarged view of a portion of the grinding tool of the present embodiment. Further, FIGS. 9A and 9B are cross-sectional views illustrating the grinding tool illustrated in FIG. 8. FIG. 9A is a cross-sectional view in an axial direction thereof, and FIG. 9B is a cross-sectional view in a radial direction thereof.

A grinding tool 10-3 of the present embodiment also uses the grinding tool 10-1 described in Embodiment 1 as a basic structure. Thus, in the description of the present embodiment, the same components as those of the grinding tool 10-1 described in Embodiment 1 are denoted using the same symbols. Further, in this embodiment as well, similar to Embodiment 2, the object is to improve chip dischargeability.

While the grinding tool 10-3 of the present embodiment also uses the grinding tool 10-1 described in Embodiment 1 as a basic structure, the grinding tool 10-3 is further provided with an axial center hole 61 that extends in the axial direction through the axial center portion thereof and, on the bottom surface 13 of the helical groove 12*a*, a plurality of communicating holes 62 that communicate with the axial center hole 61 from the bottom surface 13 of the helical groove 12. The communicating holes 62 are disposed at a predetermined interval on the bottom surface 13 of the helical groove 12.

In the case of the present embodiment, each of the communicating holes 62 is formed into a tapered shape that increases in size from the bottom surface 13 of the helical groove 12 toward an inner peripheral surface of the axial center hole 61. Then, each of the communicating holes 62 is formed so that, in a cross section in the axial direction, a center line thereof is orthogonal to the axial center S, as illustrated in FIG. 9A. Further, each of the communicating holes 62 is formed so that, in a cross section in the radial direction, the center line thereof is directed toward the axial center S, as illustrated in FIG. 9B.

In the grinding tool 10-3 of the present embodiment, when the air blow B is performed in the axial center hole 61, the chips C that were not removed and remain in the helical groove 12 pass through the communicating holes 62, are suctioned into and pass through the axial center hole 61, and are forcibly discharged to the outside. As a result, chip dischargeability is improved.

Note that a lid member (not illustrated) that blocks the axial center hole 61 may be provided in the leading end portion of the grinding tool 10-3 of the present embodiment. In such a case, when the air blow B is performed in the axial center hole 61, the chips C that were not removed and remain in the helical groove 12 are forcibly discharged to the outside by the air jetted from the communicating holes 62. As a result, chip dischargeability is improved.

In this case, each of the communicating holes 62 is formed into a tapered shape that increases in size from the inner peripheral surface of the axial center hole 61 toward the bottom surface 13 of the helical groove 12. With such a shape, entry of the chips C accumulated in the communicating holes 62 into the axial center hole 61 can be suppressed, and the chips C accumulated in the communicating holes 62 can be reliably discharged to the outside without clogging the communicating holes 62.

Note that the communicating holes 62 may each be formed so that the size is the same from the bottom surface 13 of the helical groove 12 to the inner peripheral surface of the axial center hole 61.

The base metal portion of the grinding tool 10-3 of the present embodiment described above can be easily formed by machining or using a three-dimensional stacking method. In the three-dimensional stacking method, design is performed using 3D-CAD, making it possible to easily form the base metal portion, even when there are many communicating holes 62. Then, after formation of the base metal portion, the grinding tool 10-3 according to the present embodiment can be manufactured by fixing the abrasive grains 18*a* by an electrodeposition method.

Embodiment 4

Figure 10A:
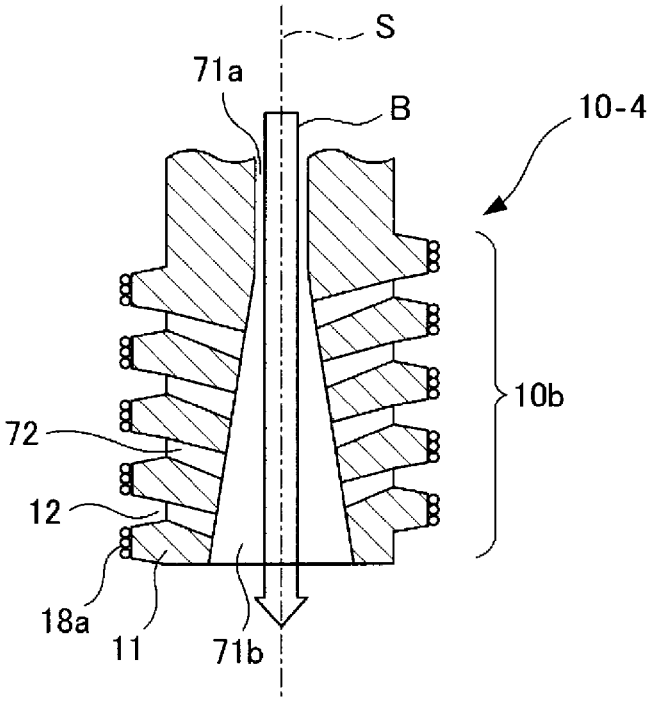
FIGS. 10A and 10B are diagrams illustrating another example (Embodiment 4) of an embodiment of the grinding tool according to the present invention.
Figure 10B:
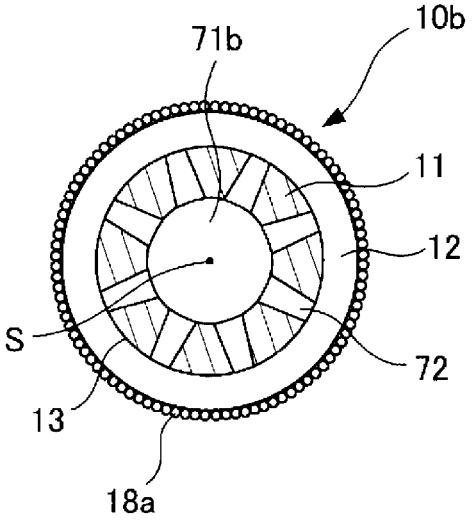

FIGS. 10A and 10B are diagrams illustrating the grinding tool of the present embodiment. FIG. 10A is a cross-sectional view in an axial direction thereof, and FIG. 10B is a cross-sectional view in a radial direction thereof. Note that the cross-sectional view in the radial direction of the present embodiment, while more accurately a cross-sectional view in the direction along the communicating hole 72 described later, is here called a cross-sectional view in the radial direction for the sake of convenience.

A grinding tool 10-4 of the present embodiment also uses the grinding tool 10-1 described in Embodiment 1 as a basic structure. Thus, in the description of the present embodiment, the same components as those of the grinding tool 10-1 described in Embodiment 1 are denoted using the same symbols. Further, in this embodiment as well, similar to Embodiments 2 and 3, the object is to improve chip dischargeability.

While the grinding tool 10-4 of the present embodiment also uses the grinding tool 10-1 described in Embodiment 1 as a basic structure, the grinding tool 10-4 is further provided with an axial center hole 71*a* that extends in the axial direction through an axial center portion thereof, a hollow portion 71*b* in the axial center hole 71*a*, and a plurality of communicating holes 72 on the bottom surface 13 of the helical groove 12. The hollow portion 71*b* has a tapered shape (a cone shape) that increases in diameter along the leading end side (lower side in the figure) of the axial center hole 71*a*, and the plurality of communicating holes 72 communicate with the hollow portion 71*b* from the bottom surface 13 of the helical groove 12. The communicating holes 72 are disposed at a predetermined interval on the bottom surface 13 of the helical groove 12.

In the case of the present embodiment, each of the communicating holes 72 is formed into a tapered shape that increases in size from the bottom surface 13 of the helical groove 12 toward an inner peripheral surface of the hollow portion 71*b*. Then, the communicating holes 72 are each formed on an incline relative to the axial center S so that, in a cross section in the axial direction, an opening on the hollow portion 71*b* side is positioned on the leading end side of an opening on the bottom surface 13 side, as illustrated in FIG. 10A. Further, the communicating holes 72 are each formed so that, in a cross section in the radial direction, a center line thereof is directed toward the axial center S, as illustrated in FIG. 10B.

In the grinding tool 10-4 of the present embodiment, when the air blow B is performed in the hollow portion 71*b* via the axial center hole 71*a*, the chips C that were not removed and remain in the helical groove 12 pass through the communicating holes 72, are suctioned into and pass through hollow portion 71*b*, and are forcibly discharged to the outside. As a result, chip dischargeability is improved.

Further, the hollow portion 71*b* is formed into a tapered shape that increases in diameter along the leading end side, making it possible to increase the suction force from the communicating holes 72 to the hollow portion 71*b*, enhance the suction capability of the chips C into the communicating holes 72, and reliably discharge the chips C to the outside from the leading end side of the head portion 10*b* without clogging the hollow portion 71*b*.

Further, each of the communicating holes 72 is formed into a tapered shape from the bottom surface 13 of the helical groove 12 toward the inner peripheral surface of the hollow portion 71*b*, making it possible to reliably feed the chips C suctioned into the communicating holes 72 to the hollow portion 71*b* without causing clogging.

Further, the axial center S side of the center line of each of the communicating holes 72 is inclined relative to the axial center S so as to be directed toward the leading end side of the head portion 10*b*, thereby making it possible to significantly suppress entry of the chips C that flow through the hollow portion 71*b* toward the leading end side into the communicating holes 72.

Note that a lid member (not illustrated) that blocks the hollow portion 71*b* may be provided in the leading end portion of the grinding tool 10-4 of the present embodiment. In such a case, when the air blow B is performed in the hollow portion 71*b* via the axial center hole 71*a*, the chips C that were not removed and remain in the helical groove 12 are forcibly discharged to the outside by the air jetted from the communicating holes 72. As a result, chip dischargeability is improved.

In this case, each of the communicating holes 72 is formed into a tapered shape that increases in size from the inner peripheral surface of the hollow portion 71*b* toward the bottom surface 13 of the helical groove 12. With such a shape, entry of the chips C accumulated in the communicating holes 72 into the hollow portion 71*b* can be suppressed, and the chips C accumulated in the communicating holes 72 can be reliably discharged to the outside without clogging the communicating holes 72.

Note that the communicating holes 72 may each be formed so that the size is the same from the bottom surface 13 of the helical groove 12 to the inner peripheral surface of the hollow portion 71*b*.

The base metal portion of the grinding tool 10-4 of the present embodiment described above can also be easily formed using a three-dimensional stacking method. In the three-dimensional stacking method, design is performed using 3D-CAD, making it possible to easily form the base metal portion, even when there are many communicating holes 72 and the shape is complex. Then, after formation of the base metal portion, the grinding tool 10-4 according to the present embodiment can be manufactured by fixing the abrasive grains 18*a* by an electrodeposition method.

Embodiment 5

Figure 11A:
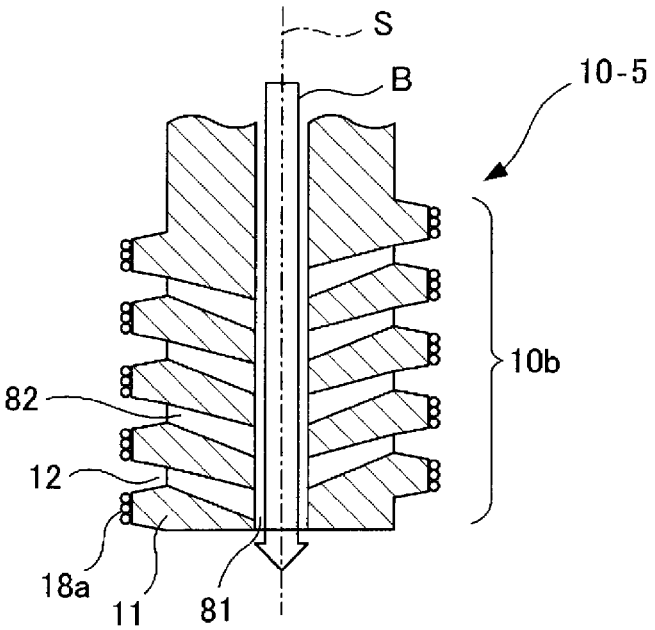
FIGS. 11A and 11B are diagrams illustrating another example (Embodiment 5) of an embodiment of the grinding tool according to the present invention.
Figure 11B:
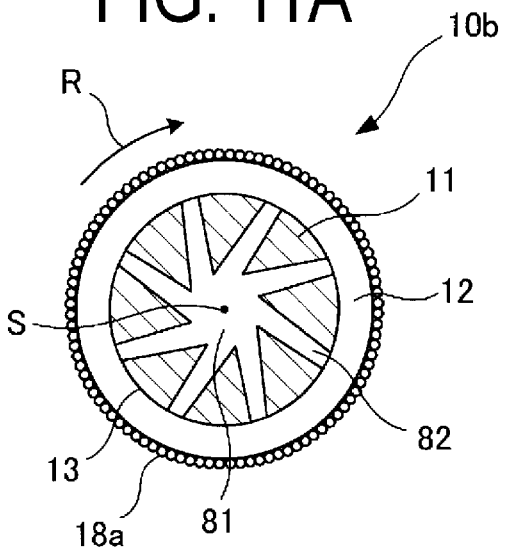

FIGS. 11A and 11B are diagrams illustrating the grinding tool of the present embodiment. FIG. 11A is a cross-sectional view in an axial direction thereof, and FIG. 11B is a cross-sectional view in a radial direction thereof. Note that the cross-sectional view in the radial direction of the present embodiment, while more accurately, a cross-sectional view in the direction along a communicating hole 82 described later, is here called a cross-sectional view in the radial direction for the sake of convenience. Further, "R" in FIGS. 11A and 11B indicates the rotational direction of the head portion 10*b*.

A grinding tool 10-5 of the present embodiment also uses the grinding tool 10-1 described in Embodiment 1 as a basic structure. Thus, in the description of the present embodiment, the same components as those of the grinding tool 10-1 described in Embodiment 1 are denoted using the same symbols. Further, in this embodiment as well, similar to Embodiments 2 to 4, the object is to improve chip dischargeability.

While the grinding tool 10-5 of the present embodiment also uses the grinding tool 10-1 described in Embodiment 1 as a basic structure, the grinding tool 10-5 is further provided with an axial center hole 81 that extends in the axial direction through an axial center portion thereof and, on the bottom surface 13 of the helical groove 12, a plurality of the communicating holes 82 that communicate with the axial center hole 81 from the bottom surface 13 of the helical groove 12. The communicating holes 82 are disposed at a predetermined interval on the bottom surface 13 of the helical groove 12. Note that the hollow portion 71*b* such as illustrated in FIG. 10B may be provided on the leading end side of the axial center hole 81.

In the case of the present embodiment, each of the communicating holes 82 is formed into a tapered shape that increases in size from the bottom surface 13 of the helical groove 12 toward an inner peripheral surface of the axial center hole 81. Then, each of the communicating holes 82 is formed on an incline relative to the axial center S so that, in a cross section in the axial direction, an opening on the axial center hole 81 side is positioned on the leading end side of an opening on the bottom surface 13 side, as illustrated in FIG. 11A. Further, each of the communicating holes 82 is formed so that, in a cross section in the radial direction, a center line thereof is directed toward a rear side in the rotational direction R from the axial center S, using the opening on the bottom surface 13 side of the helical groove 12 as a reference, as illustrated in FIG. 11B.

Thus, each of the communicating holes 82 has a linear shape with an inclination angle to a front side in the rotational direction R, relative to the radial direction of the head portion 10*b*. This inclination angle may be a value that hydrodynamically facilitates the feeding of the chips C to the axial center hole 81, taking into consideration the rotational direction R and weight of the grinding tool 10-5 during grinding.

In the grinding tool 10-5 of the present embodiment, when the air blow B is performed in the axial center hole 81, the chips C that were not removed and remain in the helical groove 12 pass through the communicating holes 82, are suctioned into and pass through the axial center hole 81, and are forcibly discharged to the outside. As a result, chip dischargeability is improved.

Further, each of the communicating holes 82 is formed into a tapered shape from the bottom surface 13 of the helical groove 12 toward the inner peripheral surface of the axial center hole 81, making it possible to reliably feed the chips C suctioned into the communicating holes 82 to the axial center hole 81 without causing clogging.

Further, the axial center S side of the center line of each of the communicating holes 82 is inclined relative to the axial center S so as to be directed toward the leading end side of the head portion 10*b*, thereby making it possible to significantly suppress entry of the chips C that flow through the axial center hole 81 toward the leading end side into the communicating holes 82.

Further, each of the communicating holes 82 has a linear shape with an inclination angle to the front side of the rotational direction R relative to the radial direction of the head portion 10*b*, making it possible to utilize the rotational force of the grinding tool 10-5 to reliably feed the chips C to the axial center hole 81 and discharge the chips C from the leading end side of the head portion 10*b* to the outside.

Note that a lid member (not illustrated) that blocks the axial center hole 81 may be provided in the leading end portion of the grinding tool 10-5 of the present embodiment. In such a case, when the air blow B is performed in the axial center hole 81, the chips C that were not removed and remain in the helical groove 12 are forcibly discharged to the outside by the air jetted from the communicating holes 82. As a result, chip dischargeability is improved.

In this case, each of the communicating holes 82 is formed into a tapered shape that increases in size from the inner peripheral surface of the axial center hole 81 toward the bottom surface 13 of the helical groove 12. With such a shape, entry of the chips C accumulated in the communicating holes 82 into the axial center hole 81 can be suppressed, and the chips C accumulated in the communicating holes 82 can be reliably discharged to the outside without clogging the communicating holes 82.

Note that the communicating holes 82 may each be formed so that the size is the same from the bottom surface 13 of the helical groove 12 to the inner peripheral surface of the axial center hole 81.

The base metal portion of the grinding tool 10-5 of the present embodiment described above can also be easily formed using a three-dimensional stacking method. In the three-dimensional stacking method, design is performed using 3D-CAD, making it possible to easily form the base metal portion, even when there are many communicating holes 82 and the shape is complex. Then, after formation of the base metal portion, the grinding tool 10-5 according to the present embodiment can be manufactured by fixing the abrasive grains 18*a* by an electrodeposition method.

Embodiment 6

Figure 12A:
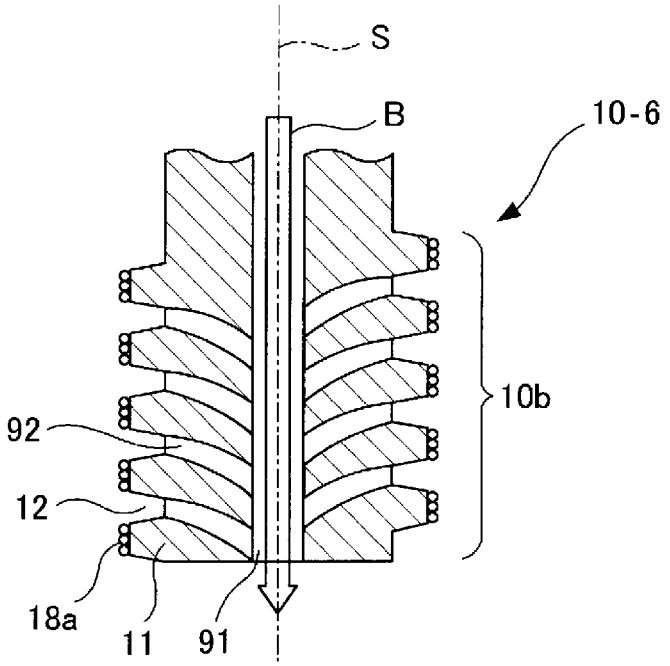
FIGS. 12A and 12B are diagrams illustrating another example (Embodiment 6) of an embodiment of the grinding tool according to the present invention.
Figure 12B:
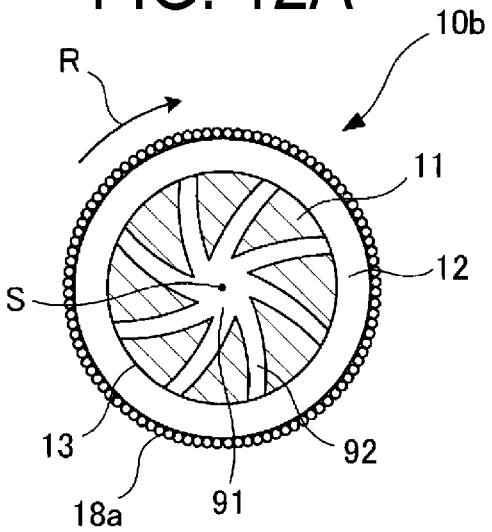

FIGS. 12A and 12B are diagrams illustrating the grinding tool of the present embodiment. FIG. 12A is a cross-sectional view in an axial direction thereof, and FIG. 12B is a cross-sectional view in a radial direction thereof. Note that, here as well, the cross-sectional view in the radial direction of the present embodiment, while more accurately a cross-sectional view in the direction along a communicating hole 92 described later, is here called a cross-sectional view in the radial direction for the sake of convenience. Further, "R" in FIGS. 12A and 12B indicates the rotational direction of the head portion 10*b*.

A grinding tool 10-6 of the present embodiment also uses the grinding tool 10-1 described in Embodiment 1 as a basic structure. Thus, in the description of the present embodiment, the same components as those of the grinding tool 10-1 described in Embodiment 1 are denoted using the same symbols. Further, in this embodiment as well, similar to Embodiments 2 to 5, the object is to improve chip dischargeability.

While the grinding tool 10-6 of the present embodiment also uses the grinding tool 10-1 described in Embodiment 1 as a basic structure, the grinding tool 10-6 is further provided with an axial center hole 91 that extends in the axial direction through an axial center portion thereof and, on the bottom surface 13 of the helical groove 12, a plurality of the communicating holes 92 that communicate with the axial center hole 91 from the bottom surface 13 of the helical groove 12. The communicating holes 92 are disposed at a predetermined interval on the bottom surface 13 of the helical groove 12. Note that the hollow portion 71*b* such as illustrated in FIG. 10B may be provided on the leading end side of the axial center hole 91.

In the case of the present embodiment, each of the communicating holes 92 is formed into a tapered shape that increases in size from the bottom surface 13 of the helical groove 12 toward an inner peripheral surface of the axial center hole 91. Then, as illustrated in FIG. 12A, each of the communicating holes 92 is formed so as to curve to a rear end side as viewed from the axial center S so that, in a cross section in the axial direction, an opening on the axial center hole 91 side is positioned on the leading end side of an opening on the bottom surface 13 side. Thus, a center line of the communicating hole 92 is inclined relative to the axial center S. Further, in a cross section in the radial direction, each of the communicating holes 92 is formed so as to curve to the rear side in the rotational direction R of the head portion 10*b*, using the opening on the bottom surface 13 side of the helical groove 12 as a reference, as illustrated in FIG. 12B.

Thus, the communicating holes 92 each have an arc shape in which the inclination of the center line of the communicating hole 92 decreases from the bottom surface 13 of the helical groove 12 toward the inner peripheral surface of the axial center hole 91. Further, the communicating holes 92 each have an arc shape that inclines to the front side in the rotational direction R relative to the radial direction of the head portion 10*b*, and has an inclination angle that increases relative to the radial direction of the head portion 10*b* from the inner peripheral surface of the axial center hole 91 toward the bottom surface 13 of the helical groove 12. These inclination angles may be values that hydrodynamically facilitate the feeding of the chips C to the axial center hole 91, taking into consideration the rotational direction R and weight of the grinding tool 10-6 during grinding.

In the grinding tool 10-6 of the present embodiment, when the air blow B is performed in the axial center hole 91, the chips C that were not removed and remain in the helical groove 12 pass through the communicating holes 92, are suctioned into and pass through the axial center hole 91, and are forcibly discharged to the outside. As a result, chip dischargeability is improved.

Further, each of the communicating holes 92 is formed into a tapered shape from the bottom surface 13 of the helical groove 12 toward the inner peripheral surface of the axial center hole 91, making it possible to reliably feed the chips C suctioned into the communicating holes 92 to the axial center hole 91 without causing clogging.

Further, the axial center S side of the center line of each of the communicating holes 92 is inclined relative to the axial center S so as to be directed toward the leading end side of the head portion 10*b*, thereby making it possible to significantly suppress entry of the chips C that flow through the axial center hole 91 toward the leading end side into the communicating holes 92.

Further, each of the communicating holes 92 has an arc shape with an inclination angle to the front side of the rotational direction R relative to the radial direction of the head portion 10*b*, and this inclination angle increases toward the outer circumferential side of the head portion 10*b*, making it possible to utilize the rotational force of the grinding tool 10-6 to reliably feed the chips C to the axial center hole 91 and discharge the chips C from the leading end side of the head portion 10*b* to the outside.

Note that a lid member (not illustrated) that blocks the axial center hole 91 may be provided in the leading end portion of the grinding tool 10-6 of the present embodiment. In such a case, when the air blow B is performed in the axial center hole 91, the chips C that were not removed and remain in the helical groove 12 are forcibly discharged to the outside by the air jetted from the communicating holes 92. As a result, chip dischargeability is improved.

In this case, each of the communicating holes 92 is formed into a tapered shape that increases in size from the inner peripheral surface of the axial center hole 91 toward the bottom surface 13 of the helical groove 12. With such a shape, entry of the chips C accumulated in the communicating holes 92 into the axial center hole 91 can be suppressed, and the chips C accumulated in the communicating holes 92 can be reliably discharged to the outside without clogging the communicating holes 92.

Note that the communicating hole 92 may be formed in the same size and so as to curve from the bottom surface 13 of the helical groove 12 to the inner peripheral surface of the axial center hole 91.

The base metal portion of the grinding tool 10-6 of the present embodiment described above can also be easily formed using a three-dimensional stacking method. In the three-dimensional stacking method, design is performed using 3D-CAD, making it possible to easily form the base metal portion, even when there are many communicating holes 92 and the shape is complex. Then, after formation of the base metal portion, the grinding tool 10-6 according to the present embodiment can be manufactured by fixing the abrasive grains 18*a* by an electrodeposition method.

INDUSTRIAL APPLICABILITY

The present invention is suitable as a grinding tool that performs grinding, and in particular is suitable for grinding carbon fiber reinforced plastics (CFRP) and the like, which are difficult to grind.

REFERENCE SIGNS LIST

10-1, 10-2, 10-3, 10-4, 10-5, 10-6 Grinding tool
10*a* Shaft portion
10*b* Head portion
11 Base metal
12 Helical groove
13 Bottom surface
14 Side surface
15 Ridgetop surface
18 Abrasive grain surface
18*a* Abrasive grain
21 Masking portion
22 Resin rope

The invention claimed is:

1. A grinding tool, comprising:
a threaded helical groove formed on an outer circumferential surface of a metal cylinder;
ridgetop surfaces that result from the formation of the helical groove and are formed so as to protrude with a trapezoidal cross-sectional shape;
abrasive grain surfaces formed by fixing abrasive grains on the ridgetop surfaces; and
communicating holes that communicate a bottom surface of the helical groove and an axial center hole;
the axial center hole comprising on an inner peripheral surface thereof a linear groove having a depth that reaches the bottom surface of the helical groove and extending along an axial direction; and
the linear groove and the bottom surface of the helical groove overlapping at the communicating hole.

2. A grinding tool according to claim 1, wherein:
a helix angle of the helical groove with respect to an axial direction of the grinding tool is set to be at least 80° and less than 90°.

3. A manufacture method of a grinding tool, the method comprising the steps of:
forming a threaded helical groove on an outer circumferential surface of a metal cylinder;
forming ridgetop surfaces that result from the formation of the helical groove so as to protrude with a trapezoidal cross-sectional shape;
forming an axial center hole that extends in an axial direction through an axial center portion of the cylinder;
forming on an inner peripheral surface of the axial center hole a linear groove having a depth that reaches a bottom surface of the helical groove and extending in the axial direction;
forming communicating holes that communicate the bottom surface of the helical groove and the axial center hole at a position where the linear groove and the bottom surface of the helical groove overlap; and
forming abrasive grain surfaces by masking an inside of the helical groove and fixing abrasive grains on the ridgetop surfaces.

4. The method of manufacturing a grinding tool according to claim 3, wherein:

the helical groove is formed so that a helix angle of the helical groove with respect to an axial direction of the grinding tool is set to be at least 80° and less than 90°.

5. The method of manufacturing a grinding tool according to claim 3, wherein the inside of the helical groove is masked by winding an insulating resin rope in the helical groove.

6. A grinding tool according to claim 1, wherein:

the communicating hole increases in size from the bottom surface of the helical groove toward the inner peripheral surface of the axial center hole.

* * * * *